US005921864A

United States Patent [19]

Walker et al.

[11] Patent Number: 5,921,864

[45] Date of Patent: Jul. 13, 1999

[54] ELECTRONIC WORD PUZZLE GAME

[75] Inventors: Jay S. Walker, Ridgefield; James Jorasch, Stamford, both of Conn.

[73] Assignee: Walker Asset Management Limited Partnership, Stamford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/618,947

[22] Filed: Mar. 20, 1996

[51] Int. Cl.[6] ..... G06F 17/21

[52] U.S. Cl. ..... 463/9; 273/272

[58] Field of Search ..... 463/9, 10; 273/272, 273/273, 429, 430, 431, 299; 434/159, 160, 167

[56] References Cited

U.S. PATENT DOCUMENTS

| | | | |
|---|---|---|---|
| 4,438,932 | 3/1984 | Finkel . | |
| 4,891,775 | 1/1990 | McWherter . | |
| 5,203,705 | 4/1993 | Hardy et al. | 434/169 |
| 5,207,435 | 5/1993 | Tanner . | |
| 5,393,062 | 2/1995 | Cember . | |
| 5,435,564 | 7/1995 | Kennedy et al. | 273/237 |

*Primary Examiner*—George Manuel
*Attorney, Agent, or Firm*—Morgan & Finnegan; Robert R. Lech

[57] ABSTRACT

An electronic word puzzle game, the game playable on a game computer having a processor for executing at least one program from associated memory, a display and an I/O interface, comprising: at least one puzzle phrase in the associated memory; a game program in the associated memory executable by the processor for randomly or determininistically choosing a solution phrase from the associated memory, the solution phrase comprising at least one of letters, spaces and punctuation marks; the I/O interface adapted for enabling the player to select at least one of letters, spaces and punctuation marks from a selection of entry keys associated with the I/O interface; the game computer generating and displaying a plurality of solution phrase constituent display areas, wherein each of said solution phrase constituent display areas corresponds to each letter, blank space, and punctuation mark of the solution phrase, on the display screen; the game program executable by the processor for comparing the at least one selected letter to the letters in the solution phrase and displaying on the display screen the selected letter in each grid box corresponding to a letter of the solution phrase for each player selected letter found in the solution phrase; and the game computer displaying in the corresponding grid box at least one of blank spaces and punctuation marks of the solution phrase adjacent to a selected letter found in the solution phrase. In an alternative embodiment, the electronic word puzzle game capable of being played at a user terminal over a data network in accordance with the invention.

29 Claims, 3 Drawing Sheets

ELECTRONIC WORD PUZZLE GAME

BACKGROUND OF THE INVENTION

The present invention relates generally to electronic games of skill, and more particularly, to a word puzzle game where a player attempts to solve a hidden phrase, quote, name or other word group. In the preferred embodiment, the word puzzle game is rendered on a game computer, but may be generated on any display within the scope of the invention.

The inventive game incorporates elements of the popular television game Wheel of Fortune, and the board game Scrabble, but differs from the prior art in several respects. In accordance with the present invention, an electronically generated puzzle grid, in a typical representative embodiment consisting of boxes arranged in a number of rows and columns, is displayed on a display screen. The player selects letters, and any ones that match those found in a solution phrase are displayed in the puzzle grid boxes. However, unlike the Wheel of Fortune game, blank spaces between words and punctuation marks, if any, are assigned an empty grid box exactly as if they were letters. As a result, the structure of the puzzle, i.e. number of different words and length of each word, remains a secret until the blank spaces are discovered. In connection with this aspect of the inventive game, the blank spaces and punctuation marks are only revealed if the player selects a letter that is adjacent to a blank space or punctuation mark.

The present invention is similar to Scrabble only with regard to how point scores are determined. In both games, a player is awarded a higher score for selecting letters that are not as commonly used in normal diction. In the inventive game however, the points are subtracted from a baseline starting total. Selection of more common letters and vowels causes more points to be subtracted, while selection of less common letters (e.g., X's, Q's, Z's and the like) causes fewer points to be subtracted. In addition, in playing the game in accordance with the present invention, the player attempts to ascertain a preselected, hidden phrase, as opposed to putting together words from a set of letters, and thus the games are fundamentally different. Points may also be added to a player's score based upon the player's response(s) to some specific or periodic machine initiated challenge(s). Benefits can also be conferred as a result of the player's score dropping below some established threshold.

In the prior art, there are a number of word puzzle games, but none teach or suggest the present invention. A primary object of the present invention provides for concealing the exact structure of a hidden phrase, including the structure/number of words in the phrase, until a player selects the letters which are adjacent to blank spaces or punctuation marks. For instance, the U.S. Pat. No. 5,207,435 to Tanner discloses a word game between two or more players involving clue cards, each having a set of scrambled words imprinted thereon, and where an unsolved main word is represented by blank spaces. From the start of this game, the players always know the exact number of letters that make up the word to be discovered as they take turns attempting to unscramble the scrambled words to find clues that help solve the main word.

U.S. Pat. No. 4,438,932 to Finkel covering an apparatus for an electronic word game, teaches a "hangman-type" game that is played between two players wherein one player selects a word by actuation of letter keys. Although the selected word is blanked out so as to preclude observation by the solving player, the other player can observe the number of letters in the selected word.

SUMMARY OF THE INVENTION

In view of the prior art, it is an object of the present invention to provide an electronic word puzzle game for players in which all the letters, spaces between words, and punctuation marks contained in a phrase, quote or name associated therewith remain hidden until the player selects the specific letters that cause the structure of the phrase or quotation to be revealed.

It is a further object of the present invention to provide an electronic word puzzle game wherein all the letters, spaces between words, and punctuation marks contained in a phrase remain hidden until the player selects the specific letters which trigger revealing, at least partially, the letters and structure of the phrase or quotation.

It is another object of the present invention to provide an electronic word puzzle game of the type described above capable of being played on-line over a data network, thereby enhancing play value and enabling players to compete in contests for rewards and prizes.

In accordance with the above objects and additional objects that will become apparent hereinafter, the present invention relates to an electronic word puzzle game, where the game is playable on a game computer having a processor for executing at least one program from associated memory, a display and an I/O interface, comprising: at least one puzzle phrase in the associated memory; a game program in the associated memory executable by the processor for randomly or deterministically choosing a solution phrase from the associated memory, the solution phrase comprising at least one of letters, spaces and punctuation marks; the I/O interface adapted for enabling the player to select at least one of letters, spaces and punctuation marks from a selection of entry keys associated with the I/O interface; the game computer generating and displaying a plurality of grid boxes, wherein each of said grid boxes corresponds to each letter, blank space, and punctuation mark of the solution phrase, on the display screen; the game program executable by the processor for comparing the at least one selected letter to the letters in the solution phrase and displaying on the display screen the selected letter in each grid box corresponding to a letter of the solution phrase for each player selected letter found in the solution phrase; and the game computer displaying in the corresponding grid box at least one of blank spaces and punctuation marks of the solution phrase adjacent to a selected letter found in the solution phrase.

In operation, the game computer determines if a selected letter is part of a phrase in connection with any given play and displays letters, punctuation and spaces in accordance with the hidden phrase for that play. The game computer scores the player's performance as a function of the letters selected, time elapsed, and attempts at solving the game.

In an alternative embodiment, the game computer enables the player to access a database of clues to facilitate solving the hidden phrase. The clue can assist the player in figuring out the correct answer, for example, by providing a related topic or general answer having some connection with, or relevance to, the solution phrase.

Since the electronic word puzzle game is computer generated in the preferred embodiment, it is amenable to on-line play over a data network. Consequently, any player having access to, for example, the Internet, could compete in tournaments or contests for prize awards, where the winner or winners are determined based upon play related factors such as, for example, time to completion.

In accordance with the on-line embodiment, the present invention includes: at least one game computer having a processor for executing at least one program from associated memory, a display and an I/O interface, the game computer further comprising: at least one puzzle phrase in the associated memory; a game program in the associated memory executable by the processor for starting an electronic puzzle game upon receipt of game data over the data network, and a central computer having associated memory and a processor for executing at least one program from the central computer associated memory, the central computer randomly or deterministically choosing a solution phrase from the associated memory, the solution phrase comprising at least one of letters, spaces and punctuation marks; the I/O interface adapted for enabling the player to select at least one of letters, spaces and punctuation marks from a selection of entry keys associated with said I/O interface of said game computer; the central computer generating display data corresponding to a plurality of grid boxes, wherein each of said grid boxes corresponds to each letter, blank space, and punctuation mark of said solution phrase, and communicating the display data to the game computer over the data network for display on the display screen; the central computer comparing the at least one selected letter to the letters in the solution phrase and generating display data for communication to the game computer over the data network to enable displaying on the display screen the selected letter in each grid box corresponding to a letter of the solution phrase for each player selected letter found in the solution phrase; and the game computer displaying in the corresponding grid box the at least one of blank spaces and punctuation marks of the solution phrase adjacent to a selected letter found in the solution phrase.

DESCRIPTION OF THE PREFERRED EMBODIMENTS

Figure 1A:
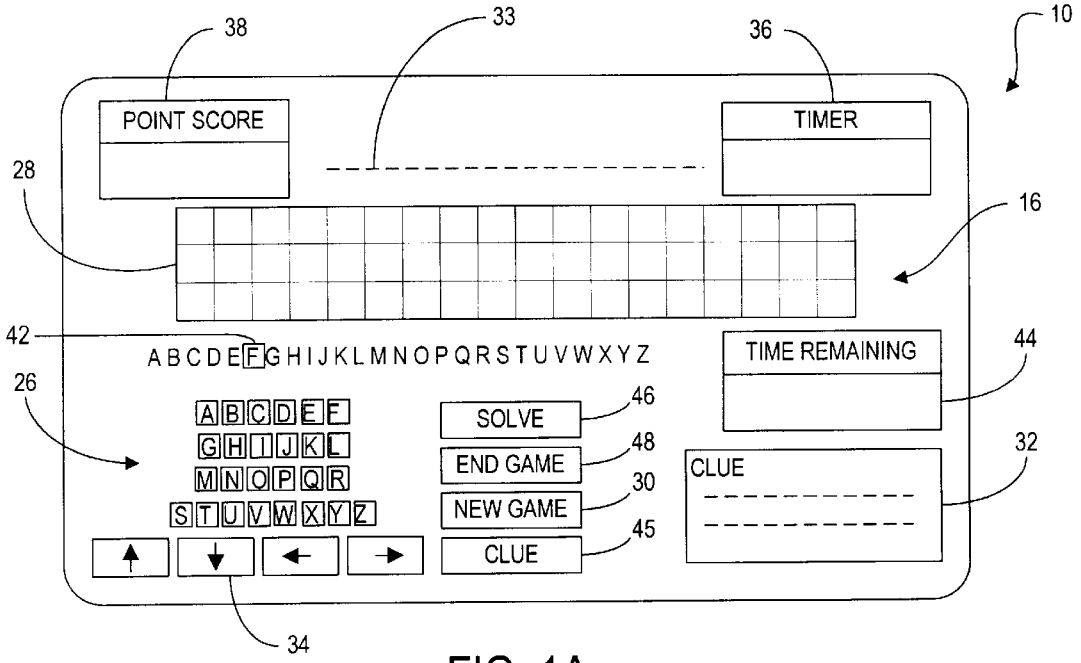
FIG. 1A is a plan view of an exemplary hand held game computer in accordance with the present invention.

Referring now to the several views of the drawings, there are depicted several embodiments of the present invention, principally comprised of a game computer 10 having a processor 12 for executing at least one program from associated memory 14, a display 16 and an I/O interface 18. As the operation of game computers is well-known in the art, it need not be described here in detail.

Figure 1B:
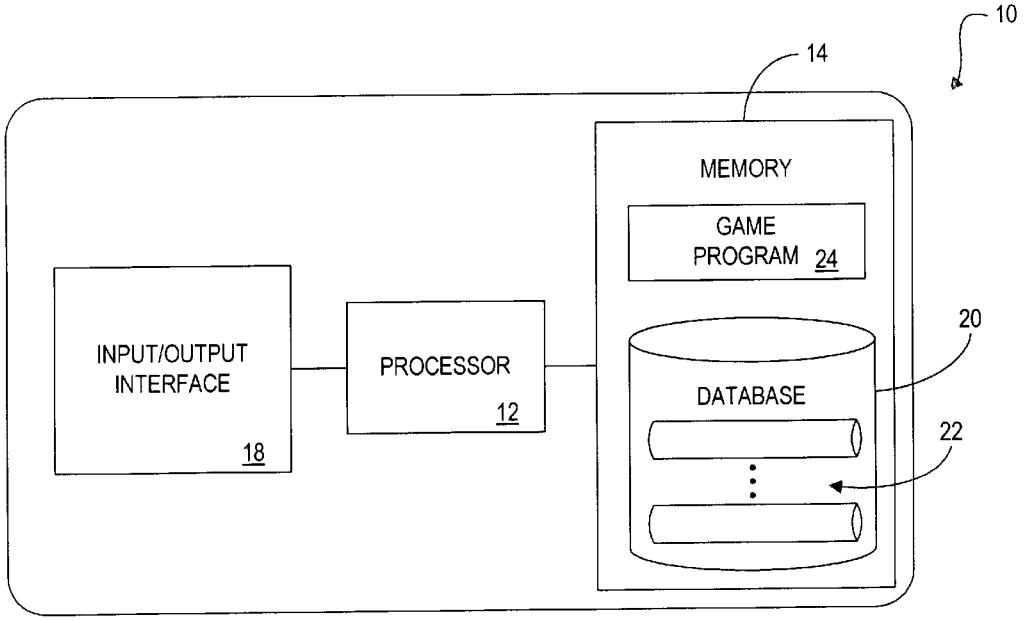
FIG. 1B is a schematic of the game computer.
Figure 2:
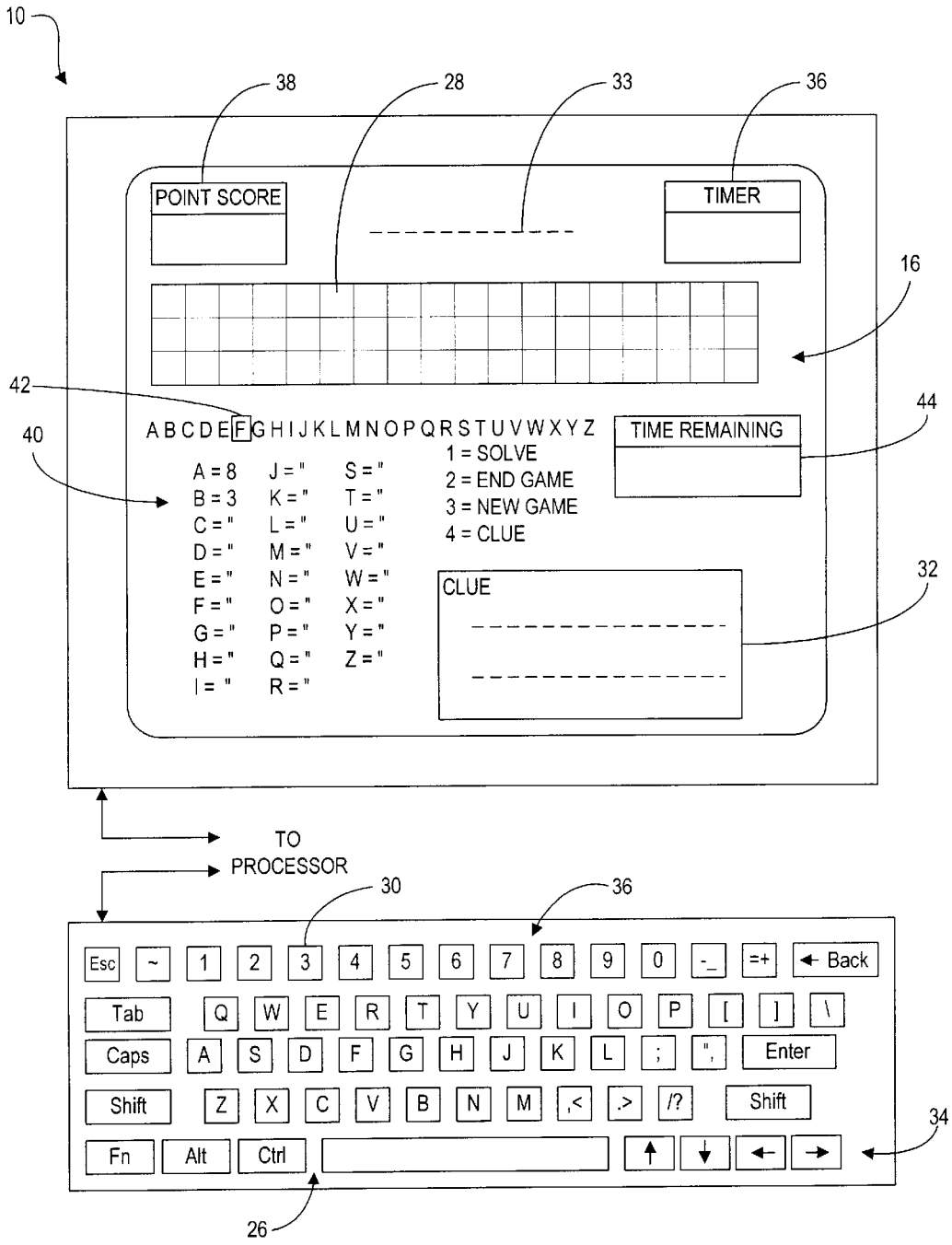
FIG. 2 is a front elevational view of a monitor display screen and exemplary keyboard.

In a preferred embodiment shown in FIGS. 1A, 1B and 2, the game computer 12 contains at least one database 20 in associated memory 14 that contains a list of puzzle phrases shown schematically at 22. Alternatively, puzzle phrases are not stored in a database, but simply communicated to the game computer over a data link, such as on-line as described in more detail below. The game computer includes at least one program or routine (the "game program 24") that is executable by the processor 12 to facilitate all aspects of game play, including the random selection or generation of a solution phrase 22 from the database 20. The solution phrase 22 comprises at least one of letters, spaces and punctuation marks. As discussed in the foregoing, the inventive game provides for revealing the spaces and/or punctuation marks around each correctly guessed letter in the solution phrase 22. The player selects the letters via the I/O interface 18 from a selection of entry keys 26 associated therewith in a conventional manner.

The game computer display 16 is enabled by a suitable driver (not shown) operating under control of the processor 12, and is adapted to display a plurality of solution phrase constituent display areas such as, for example, grid boxes 28 in accordance with game program instructions and the player's selections. Each grid box 28 corresponds to at least one of a letter, blank space, and punctuation mark in the solution phrase 22. Blank spaces and punctuation marks that border a selected letter are sequentially revealed as the player's letter selections are matched to the solution phrase 22 from the database 20, or when the player's score drops below some predetermined threshold as described below.

The objective of the electronic word puzzle game is to solve a hidden phrase or quotation as quickly as possible. To begin a game, the player presses the NEW GAME key 30 of the keyboard 26 as shown in FIG. 1A, or the numeric key "3" and ENTER as depicted in the embodiment of FIG. 2. The display 16 thereafter presents a plurality of potential topic headings (e.g., "sports," "science," etc.), from which the player selects a topic via the scroll keys 34 (see FIG. 1A) or numeric keys 36 (see FIG. 2). The player is then prompted to select a particular category (e.g., "football"). The selected topic heading 33 is rendered, in the illustrative embodiment, at the top of the display 16. A randomly or deterministically chosen phrase or quotation relating to the topic heading is then generated by executing the game program 24, and the phrase format is partially rendered in a grid of empty boxes 28 in, for example, two (2) or three (3) lines as shown in the sample embodiment, depending on the length of the phrase/quotation. In the illustrative embodiment, words in the phrase/quotation do not wrap around or hyphenate from line to line, but this may be varied if desired within the scope of the invention. Each line of grid boxes 28 contains one or more words. Although grid boxes 28 are provided for spaces and punctuation marks between words, blank spaces do not appear at the beginning or end of a line. Further, numerals do not appear in the puzzles, although numbers may be spelled out.

In the exemplary embodiment, each game takes a predetermined amount of time in which to solve the puzzle (for example, five (5) minutes). A three hundred (300) second countdown timer 36 appears at the top right corner of the display 16. The player begins the game with 1000 points. These "points" are depleted as the game progresses. The number of points remaining appear as the points scored 38 in the top left corner of the display 16. Any points that remain after the puzzle is solved represent the player's final score for that game. Thus, a higher score is indicative of a faster time to solution. If the puzzle is not solved before the predetermined time period expires, the player's final score is reduced to some final value (e.g., zero (0)).

The timer begins counting down after the player selects/buys a letter from the letter keys 26. Each letter is assigned a corresponding pre-set point value represented on the letter keys 26 (see FIG. 1A), or in a point value chart 40 on the display 16 (see FIG. 2). Common letters (e.g vowels, t's and s's), cost the player more points. Once a letter has been purchased/chosen, the selected letter appears in a letter status chart 42 disposed just below the puzzle grid boxes 28. To start each game, a player can select up to three (3) letters. After the start, the player can select only one letter for every ten (10) second interval. In accordance with the exemplary embodiment, letter purchasing privileges may not be saved. The display 16 provides the player with a time interval status 44. If the player attempts to select the same letter again, or attempts to select two letters within the same ten second interval, an audible tone may be generated (via the appropriate sound hardware/drivers—not shown) to signal the player of the mistake. Attempting to buy the same letter a second time can result in a penalty that is deducted from the player's total points. In addition, the player is notified of a mistake on the message portion 32 of the display screen 16.

If the selected/purchased letter matches a letter in the hidden phrase/quotation, that letter is revealed in the appropriate grid box 28. Points are automatically deducted from the player's total points for every grid box 28 in the puzzle where the selected letter appears. For example, if the player selects the letter "e" (e.g., equating to 8 points) and, there are a total of five (5) e's in the solution phrase, he is charged the corresponding point value (40 points) against the outstanding point total. If there is no match, a predetermined point selection cost is automatically deducted in the recognition that the knowledge that a particular letter is not in the solution facilitates solving the puzzle.

A player cannot select/buy punctuation marks (e.g., hyphens, apostrophes, etc.). Instead, punctuation marks are awarded free of charge whenever a player selects/buys a letter which is adjacent to a blank space or punctuation mark.

Another feature of the invention is the ability to generate a "clue" on the message portion 32 of the display screen 16. If the player so chooses, he may press the CLUE key 45 (see FIG. 1A), or the numeric key "4" and ENTER (see FIG. 2), and the game will generate a message on the message portion 32 that hints at the solution. In the depicted embodiment, a predetermined quantity of points are deducted from a player's total score for each clue selected.

As the game proceeds, points are continuously deducted. During the first minute of play, in the illustrative embodiment, a first number of points per second are automatically deducted from the player's score. In the second minute, a second number of points per second are deducted. Thereafter, a third point quantity per second is deducted until the game ends after some predetermined time. Points may also be added to a player's score based upon the player's response(s) to some specific or periodic machine initiated challenge(s). Benefits can also be conferred as a result of the player's score dropping below some established threshold. In such a situation, the player may receive clues, or certain missing elements of the puzzle may be revealed. For example, if the player's score drops below "800 points", all blank spaces in the solution phrase may be revealed at no cost to the outstanding point total.

When the player believes that he has solved the puzzle, he presses the SOLVE key 46 (see FIG. 1A), or the numeric key "1" and ENTER (see FIG. 2). This action automatically stops the clock (a solution time-out). The player then has up to thirty (30) seconds to type in the proposed solution. A cursor immediately starts blinking in the first empty grid box 28 in the first row. In the embodiment depicted in FIG. 1A, the scroll keys 34 are used to move the cursor from empty grid box 28 to empty grid box 28. In FIG. 2, the cursor is controlled by the standard key controls associated with the keyboard 26. If the solution is correct, the game ends and the player's final score is displayed in the points score 38 when the clock was stopped. If the solution is incorrect, the sum of points from the time-out period, and a penalty of X points are deducted from the player's total score. The game restarts and continues until the five-minute clock has elapsed. After the time period has expired, the player is allotted a specified amount of time to enter the correct solution. The player's score is adjusted to zero (0) if the wrong solution is entered. At any time, the player may choose to quit a game in progress by pressing the END GAME key 48 (see FIG. 1A), or the numeric key "2" and ENTER (see FIG. 2).

Figure 3:
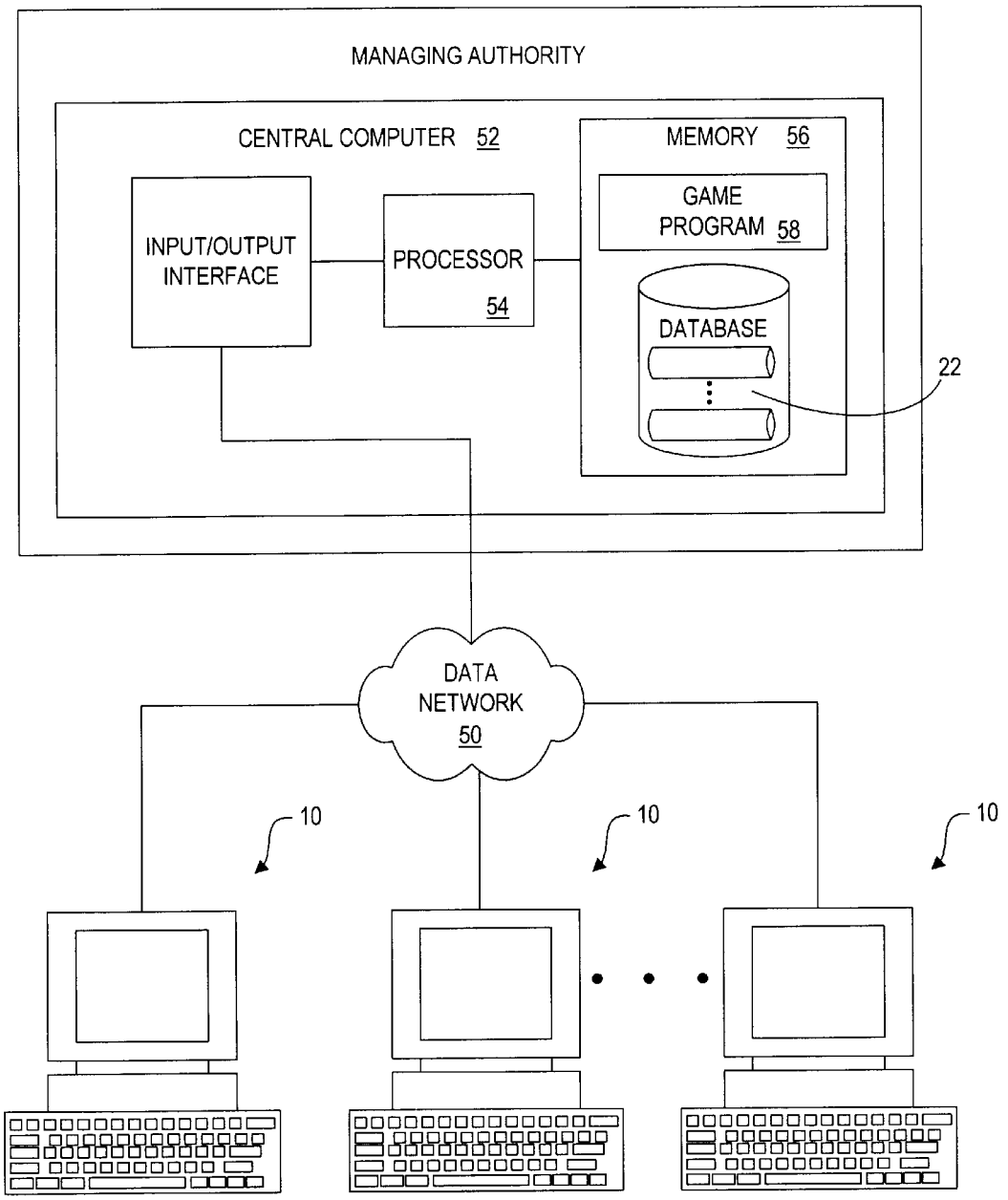
FIG. 3 depicts a block diagram of an on-line system including a central computer, and at least one game computer that communicates with the central computer over a data network for conducting tournaments/contests in accordance with the present invention.

In another embodiment shown schematically in FIG. 3, the electronic word puzzle game may be made available on-line over a data network shown generically at 50 (of the types well known in the art such as AMERICA ON-LINE, COMPUSERVE, the INTERNET, or even a dedicated game network), and thereby accessible to players via game computers 10 at any location. In this implementation, the game is controlled by a central computer 52, which generally comprises a processor 54, associated memory 56 and an input/output interface for communicating data over the data network 50 as is also well known. The central computer associated memory contains a game program 58, and a database of solution phrases 22 or some mechanism or routine for generating solution phrases 22 as discussed above. The only difference from the prior embodiment, is that the game is being generated and controlled at the central computer 52 (the host), and game data is transmitted over the data network to the game computer 10, which then renders the game for the player at the remote location. Game data such as point scoring and the like is polled by, or otherwise communicated to, the central computer 52 from the game computer 10, to facilitate tournaments, contests and the like.

The objective and rules of the game remain the same. The central computer 50 may be associated with a managing authority that runs tournaments and contests, wherein the players who attain the highest scores are rewarded with prizes or cash.

In an exemplary tournament or contest, the players may be required to pay entry fees of $2 for a group of three (3) games. Practice rounds may be made available for a cost of $1 for X games. Puzzles used for practice are not used in tournaments/contests. As currently envisioned, players prepay for tournament/contest entries, either by calling an 800 number and providing the managing authority with a credit card, or by calling a 900 number.

Recognizing that entry fees, prizes, etc. could vary depending on a number of factors (e.g. the number of players), the preferred embodiment envisions a new tournament, starting every week on a specified day and at possibly, a specified time, in which prizes are awarded to the one-hundred (100) highest three (3)-game averages for that week. In this connection, the previous weeks' winning scores may also be posted.

The three-game puzzle sets are pre-grouped. To equalize the difficulty, each puzzle group consists of approximately one-hundred (100) letters for all three puzzles for each puzzle in the group. One puzzle in a given group may be longer, while another puzzle in that group may be shorter. This facilitates equalization of solving difficulty between groups. Therefore, contestants may not substitute a score for a game in one group for a score achieved in a game for another group. Further, all three (3) games need not be played in a single session. However, once initiated, a game must be played to completion or it will be assigned a score of zero.

Each week, in an illustrative application, a grand prize of $1000 may be awarded, where a second prize brings $500, a third prize $250, and fourth through tenth prizes of $100.

Prizes 11–100 may result in $10 worth of entry fee credits. In addition, players may select the category for which their puzzles will be drawn. Bonus prizes of $100 may be awarded for the highest average score in each category.

If play is interrupted during a game, or if there is any indication of tampering, including evidence of computer assistance, the entire three-game entry may be subject to forfeit. This decision can be made at the discretion of the tournament director, who may also provide a free replacement entry if it was determined that the game interruption was not the fault of the contestant.

The present invention has been shown and described in what are considered to be the most practical and preferred embodiments. It is anticipated, however, that departures may be made therefrom and that obvious modifications will be implemented by persons skilled in the art.

We claim:

1. A method for conducting a word puzzle game, comprising the steps of:

initializing score data representing a score;

determining a puzzle phrase, the puzzle phrase comprising a plurality of characters, each of the plurality of characters being selected from the group consisting of letters, spaces and punctuation marks;

displaying a plurality of display areas, each display area corresponding to one of the plurality of characters of the puzzle phrase;

receiving a player selection, the player selection being selected from a plurality of player selectable characters consisting of letters, spaces and punctuation marks;

updating the score data, thereby decreasing the score based on an elapsed time;

comparing the player selection to at least one character of the puzzle phrase to determine whether the player selection matches any of the at least one character of the puzzle phrase; and displaying each character of the puzzle phrase determined to match the player selection.

2. The method of claim 1 wherein the step of determining a puzzle phrase includes the step of receiving a transmitted puzzle phrase.

3. The method of claim 1 wherein the step of determining a puzzle phrase includes the step of receiving a category identifier.

4. The method of claim 1 wherein the step of updating the score data includes the step of decreasing the score data based on a point value corresponding to the player selection.

5. The method of claim 1 further including the steps of:

initializing point data representing a plurality of point values, each point value corresponding to one of the plurality of player selectable characters; and updating at least a portion of the point data based on an elapsed time.

6. The method of claim 1 further including the steps of:

receiving a request to display a clue corresponding to the puzzle phrase; and displaying the clue.

7. The method of claim 6 wherein the step of displaying the clue includes the step of displaying at least one character of the puzzle phrase.

8. The method of claim 1 further including the steps of:

determining, for each character of the puzzle phrase selected from the group consisting of spaces and punctuation marks, whether the character is adjacent to a character of the puzzle phrase that has been determined to match the player selection; and displaying each character of the puzzle phrase selected from the group consisting of spaces and punctuation marks that has been determined to be adjacent to a character of the puzzle phrase that has been determined to match the player selection.

9. A method for conducting a word puzzle game comprising the steps of:

receiving initialized score data representing a score;

displaying the score based on the initialized score data;

receiving display area data representing a plurality of display areas, each display area corresponding to a character of a puzzle phrase, each character being selected from the group consisting of letters, spaces and punctuation marks;

displaying the plurality of display areas;

receiving a player selection, the player selection being selected from a plurality of player selectable characters consisting of letters, spaces and punctuation marks;

transmitting the player selection to a central server;

receiving updated score data representing the score;

displaying the score based on the updated score data;

receiving a solution character corresponding to at least one display area; and displaying the solution character.

10. An apparatus for conducting a word puzzle game, the apparatus comprising:

a processor; and a memory connected to the processor storing a program to control the operation of the processor;

the processor operative with the program in the memory to:

initialize score data representing a score;

determine a puzzle phrase, the puzzle phrase comprising a plurality of characters, each of the plurality of characters being selected from the group consisting of letters, spaces and punctuation marks;

display a plurality of display areas, each display area corresponding to one of the plurality of characters of the puzzle phrase;

receive a player selection, the player selection being selected from a plurality of player selectable characters consisting of letters, spaces and punctuation marks;

update the score data, thereby decreasing the score based on an elapsed time;

compare the player selection to at least one character of the puzzle phrase to determine whether the player selection matches any of the at least one character of the puzzle phrase; and display each character of the puzzle phrase determined to match the player selection.

11. The apparatus of claim 10 wherein the processor is further operative with the program in the memory to receive a transmitted puzzle phrase.

12. The apparatus of claim 10 wherein the processor is further operative with the program in the memory to receive a category identifier.

13. The apparatus of claim 10 wherein the processor is further operative with the program in the memory to decrease the score data based on a point value corresponding to the player selection.

14. The apparatus of claim 10 wherein the processor is further operative with the program in the memory to:

initialize point data representing a plurality of point values, each point value corresponding to one of the plurality of player selectable characters; and update at least a portion of the point data based on an elapsed time.

15. The apparatus of claim 10 wherein the processor is further operative with the program in the memory to:

receive a request to display a clue corresponding to the puzzle phrase; and display the clue.

16. The apparatus of claim 15 wherein the processor is further operative with the program in the memory to display at least one character of the puzzle phrase.

17. The apparatus of claim 10 wherein the processor is further operative with the program in the memory to:

determine, for each character of the puzzle phrase selected from the group consisting of spaces and punctuation marks, whether the character is adjacent to a character of the puzzle phrase that has been determined to match the player selection; and display each character of the puzzle phrase selected from the group consisting of spaces and punctuation marks that has been determined to be adjacent to a character of the puzzle phrase that has been determined to match the player selection.

18. An apparatus for conducting a word puzzle game, the apparatus comprising:

a processor; and a memory connected to the processor storing a program to control the operation of the processor, the processor operative with the program in the memory to:

receive initialized score data representing a score;

display the score based on the initialized score data;

receive display area data representing a plurality of display areas, each display area corresponding to a character of a puzzle phrase, each character being selected from the group consisting of letters, spaces and punctuation marks;

display the plurality of display areas;

receive a player selection, the player selection being selected from a plurality of player selectable characters consisting of letters, spaces and punctuation marks;

transmit the player selection to a central server;

receive updated score data representing the score;

display the score based on the updated score data;

receive a solution character corresponding to at least one display area; and display the solution character.

19. An apparatus for conducting a word puzzle game, the apparatus comprising:

means for initializing score data representing a score;

means for determining a puzzle phrase, the puzzle phrase comprising a plurality of characters, each of the plurality of characters being selected from the group consisting of letters, spaces and punctuation marks;

means for displaying a plurality of display areas, each display area corresponding to one of the plurality of characters of the puzzle phrase;

means for receiving a player selection, the player selection being selected from a plurality of player selectable characters consisting of letters, spaces and punctuation marks;

means for updating the score data, thereby decreasing the score based on an elapsed time;

means for comparing the player selection to at least one character of the puzzle phrase to determine whether the player selection matches any of the at least one character of the puzzle phrase; and means for displaying each character of the puzzle phrase determined to match the player selection.

20. The apparatus of claim 19 further comprising means for receiving a transmitted puzzle phrase.

21. The apparatus of claim 19 further comprising means for receiving a category identifier.

22. The apparatus of claim 19 wherein the means for updating the score data includes means for decreasing the score data based on a point value corresponding to the player selection.

23. The apparatus of claim 22 further comprising:

means for initializing point data representing a plurality of point values, each point value corresponding to one of the plurality of player selectable characters; and means for updating at least a portion of the point data based on an elapsed time.

24. The apparatus of claim 22 further comprising:

means for receiving a request to display a clue corresponding to the puzzle phrase; and means for displaying the clue.

25. The apparatus of claim 24 wherein the means for displaying the clue includes means for displaying at least one character of the puzzle phrase.

26. The apparatus of claim 22 further comprising:

means for determining, for each character of the puzzle phrase selected from the group consisting of spaces and punctuation marks, whether the character is adjacent to a character of the puzzle phrase that has been determined to match the player selection; and means for displaying each character of the puzzle phrase selected from the group consisting of spaces and punctuation marks that has been determined to be adjacent to a character of the puzzle phrase that has been determined to match the player selection.

27. An apparatus for conducting a word puzzle game, the apparatus comprising:

means for receiving initialized score data representing a score;

means for displaying the score based on the initialized score data;

means for receiving display area data representing a plurality of display areas, each display area corresponding to a character of a puzzle phrase, each character being selected from the group consisting of letters, spaces and punctuation marks;

means for displaying the plurality of display areas;

means for receiving a player selection, the player selection being selected from a plurality of player selectable characters consisting of letters, spaces and punctuation marks;

means for transmitting the player selection to a central server;

means for receiving updated score data representing the score;

means for displaying the score based on the updated score data;

means for receiving a solution character corresponding to at least one display area; and means for displaying the solution character.

28. A computer-readable storage medium encoded with processing instructions for implementing a method for conducting a word puzzle game, said processing instructions for directing a computer to perform the steps of:

initializing score data representing a score;

determining a puzzle phrase, the puzzle phrase comprising a plurality of characters, each of the plurality of characters being selected from the group consisting of letters, spaces and punctuation marks;

displaying a plurality of display areas, each display area corresponding to one of the plurality of characters of the puzzle phrase;

receiving a player selection, the player selection being selected from a plurality of player selectable characters consisting of letters, spaces and punctuation marks;

updating the score data, thereby decreasing the score based on an elapsed time;

comparing the player selection to at least one character of the puzzle phrase to determine whether the player selection matches any of the at least one character of the puzzle phrase; and displaying each character of the puzzle phrase determined to match the player selection.

29. A computer-readable storage medium encoded with processing instructions for implementing a method for conducting a word puzzle game, said processing instructions for directing a computer to perform the steps of:

receiving initialized score data representing a score;

displaying the score based on the initialized score data;

receiving display area data representing a plurality of display areas, each display area corresponding to a character of a puzzle phrase, each character being selected from the group consisting of letters, spaces and punctuation marks;

displaying the plurality of display areas;

receiving a player selection, the player selection being selected from a plurality of player selectable characters consisting of letters, spaces and punctuation marks;

transmitting the player selection to a central server;

receiving updated score data representing the score;

displaying the score based on the updated score data;

receiving a solution character corresponding to at least one display area; and displaying the solution character.

* * * * *